United States Patent [19]

Lin

[11] Patent Number: 5,064,381

[45] Date of Patent: Nov. 12, 1991

[54] ELECTRIC CONNECTING DEVICE

[76] Inventor: Yu-Chuan Lin, 2Fl., No. 12, Lane 121, Li Hsing Rd., Sec. 2, San Chung, Taipei, Taiwan

[21] Appl. No.: 664,354

[22] Filed: Mar. 4, 1991

[51] Int. Cl.[5] ..... H01R 13/54

[52] U.S. Cl. ..... 439/326

[58] Field of Search ..... 439/296, 326, 629–637

[56] References Cited

U.S. PATENT DOCUMENTS

| | | | |
|---|---|---|---|
| 3,848,952 | 11/1974 | Tighe, Jr. | 439/326 |
| 4,128,289 | 12/1978 | Ochipinti | 439/326 |
| 4,713,013 | 12/1987 | Regnier et al. | 439/326 |

*Primary Examiner*—Joseph H. McGlynn

*Attorney, Agent, or Firm*—Asian Pacific International Patent & Trademark Office

[57] ABSTRACT

An electric connecting device composed of a subsidiary board, a main board, a base and multiple electric conducting plates, wherein a U-shaped groove is disposed on two sides of the base, and a locking latch is disposed beside the U-shaped groove, a slantly curved locking projecting portion being formed on the locking latch whereby the subsidiary board can be quickly installed or removed without slipping, an inclined locking pin being inserted into the U-shaped groove whereby the subsidiary board can be installed in a vertical manner or an inclined manner, stop blocks being disposed in an insert groove of the base at large and small intervals so that two kinds of subsidiary boards with different intervals can employ the same electric connecting device.

1 Claim, 6 Drawing Sheets

ELECTRIC CONNECTING DEVICE

BACKGROUND OF THE INVENTION

The present invention relates to an electric connecting device, and more particularly to an electric connecting device wherein a subsidiary board can be installed in a vertical manner or an inclined manner, and stop blocks are disposed in an insert groove of the base at large and small intervals so that two kinds of subsidiary boards with two different intervals can be used in the same electric connecting device.

It is well known that a print circuit board can form a socket terminal used in an electric connecting device. A conventional connecting device can provide a connection with low inserting force. However, a shortcoming exists in conventional connecting device, i.e., the subsidiary board thereof can not be installed or removed quickly without picking open a locking latch disposed on the base. Also, the subsidiary board can not be alternatively used in the electric connecting device in vertical type or inclined type.

Moreover, conventional electric connecting device can only employ a subsidiary board with a specific interval so that when designing a circuit, several connecting devices with different intervals must be purchased due to the limitation of circuit designing room.

Therefore, an electric connecting device which can not apply subsidiary board with different intervals is not satisfactory nowadays.

Moreover, the guide post of conventional connecting device is poor designed. Therefore, when manufacturing, assembling and carrying, the guide post often breaks at its basic portion.

Also, the conducting plate of the electric connecting device of low insertion force can not be overlapped in row pattern and inserted into the spaced groove at a time. Only a single conducting plate is inserted into the spaced groove. Therefore, this procedure is quite time-costing.

Furthermore, when installing or removing the subsidiary board, the locking latch of the connecting device must be pick open by hand or tool for taking out the subsidiary board. This procedure is time-wasting and labor-wasting and the operator might feel painful when picking open the locking latch.

SUMMARY OF THE INVENTION

It is a primary object of this invention to provide an electric connecting device wherein the locking projecting portion of the locking latch is curved so that the subsidiary board can be removed by means of lightly pushing the subsidiary board. Therefore, due to the elasticity of the locking latch, the locking latch will be forced to stretch outward, enabling the subsidiary board to be quickly taken out.

It is a further object of this invention to provide the above electric connecting device wherein stop blocks with large and small intervals are disposed in an insert groove of the base. The stop blocks cooperate with the recess grooves of the subsidiary board for permitting two kinds of subsidiary boards with different intervals to be used.

It is still a further object of this invention to provide the above electric connecting device wherein the guide post is reinforced to avoid break.

It is still a further object of this invention to provide the above electric connecting device wherein several rows of overlapped connecting plates can be inserted into a spaced groove at a time to save time and labor.

It is still a further object of this invention to provide the above electric connecting device wherein the subsidiary board can be alternatively installed on the base in vertical manner or in inclined manner.

It is still a further object of this invention to provide the above electric connecting device wherein several bases can be connected in series by a connecting member for increasing the firmness of the base on the main board, and a number of bases can be installed on the main board at a time to save time.

DETAILED DESCRIPTION OF THE PREFERRED EMBODIMENT

Figure 1:
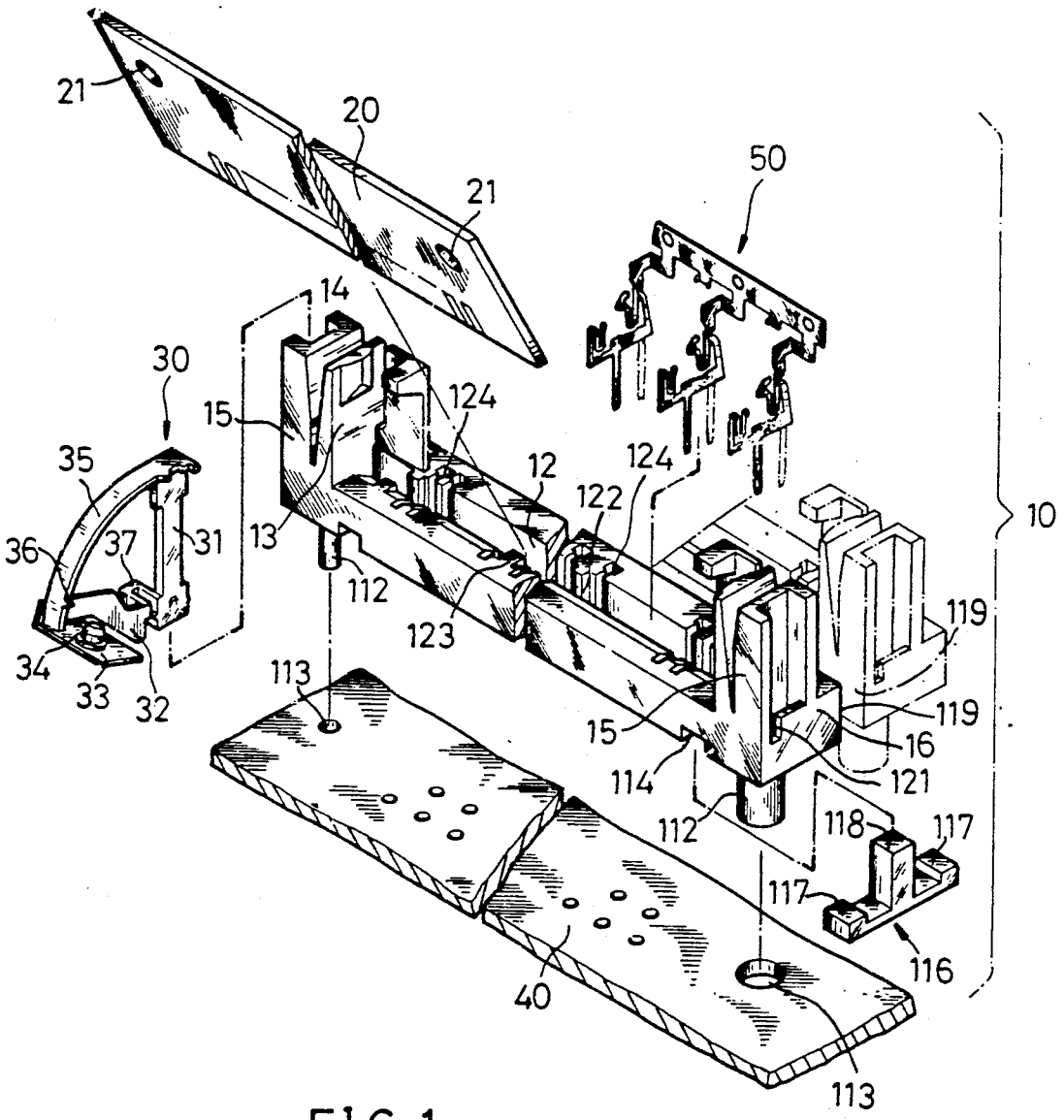
FIG. 1 is a perspective exploded view of this invention.
Figure 2:
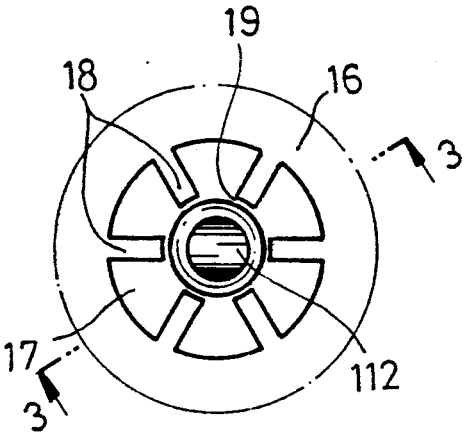
FIG. 2 is a sectional view of the guide post of the base wherein six support ribs are disposed around the guide post.
Figure 3:
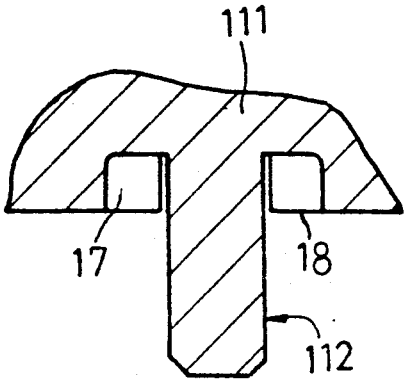
FIG. 3 is a sectional view taken on line 3—3 of FIG. 2.
Figure 7:
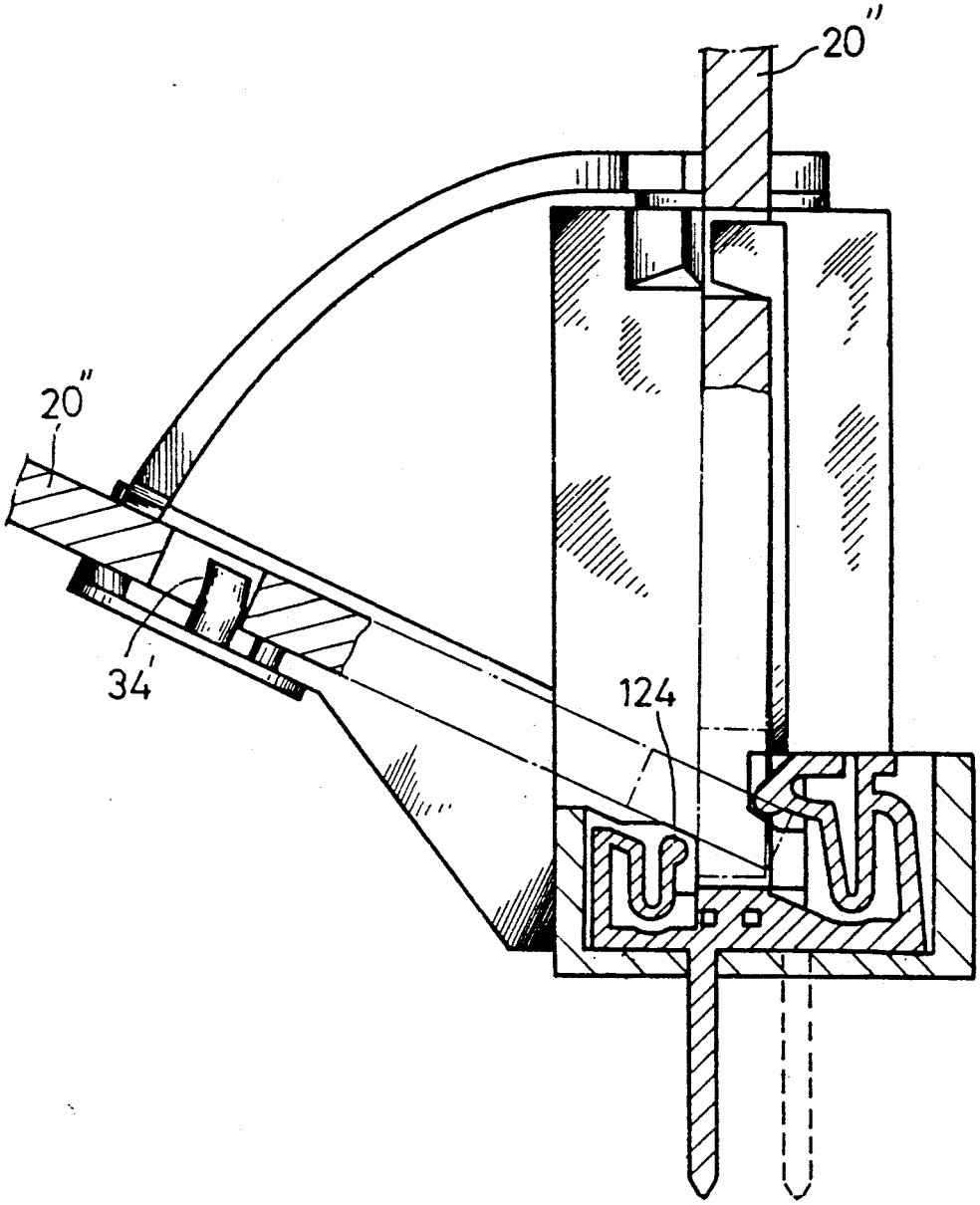
FIG. 7 is a longitudinal sectional view of the small interval subsidiary board after installed.

Please first refer to FIGS. 1 through 3. The present invention includes a base 16 made of synthetic insulating resin and formed with six inward extending support ribs 18. A chamber 17 is formed between the base 16 and the support ribs 18. A guide post 112 is disposed in the chamber 17 and protrudes beyond the base 16 so that a main board 40 can be disposed under the base 16 with the guide post 112 extending through a hole 113. A clearance 19 is formed between the support ribs 18 and the guide post 112. In case the guide post 112 is slightly bent (but not broken), the support ribs 18 can support and protect the guide post 112 so as to enhance the guide post 112 and base 16. If no chambers 17 are disposed and only clearances 19 exist during manufacturing, the mold core will be too thin and therefore during the molding process of synthetic resin, the mold core often breaks. Thus, the chamber 17 can increase the forced area of the mold core to prevent the same from breaking. On central portion of the base 16 is formed an insert groove 12 in which several spaced channels 124 are formed. A slantly curved locking projection 14 is formed at the top of a locking latch 13 which is located at two ends of the insert groove 12 perpendicularly to the base 16. The locking projection 14 projects from the lateral end of the locking latch 13 whereby when a subsidiary board 20 is installed or removed, the subsidiary board 20 can be lightly pushed and quickly installed or removed by means of the elasticity of the slantly curved locking projection 14. Therefore, the subsidiary board 20 can be installed or removed without using a hand or a tool to pick open the locking latch 13. At two ends of the base 16 are formed a U-shaped groove 15 which is perpendicular to the base 6. An inclined locking latch 30 can be inserted in the U-shaped groove 15. The subsidiary board 20 can be of vertically connection type or inclined connection type according to requirement. The vertically connection type needs a higher using room while the inclined connection type needs a wider using room with smaller height. A latch pin 31 of the inclined locking latch 30 can be inserted into the U-shaped groove 15. An engaging recess 121 is formed at the open end of the U-shaped groove 15 whereby an engaging plate 37 laterally extending from an insert pin 31 can engage with the engage recess 121, and an elastic plate 33 is perpendicularly disposed on the bottom of a connecting plate which faces 25 upward along the extending portion of the engaging plate 37. On the elastic plate 33 is formed a fixing boss 34. The fixing boss 34 is riveted on the elastic plate 33 or a fixing boss 341 can be formed by punching the elastic plate 33 as shown in FIG. 7. An arch board 35 is disposed at the top of the insert pin 31 and a locking protrusion 36 is formed on the arch board 35 whereby when using the inclined locking latch 30, the subsidiary board 20 can be lightly pushed to be installed or removed with a fixing hole 21 thereof engaged with the fixing boss 34 so that the subsidiary board 20 can be installed in vertical manner or inclined manner.

A groove 114 is disposed on inner sides of two guide posts 112. On central portion of the groove 114 is formed a through channel 115. A series of connecting members 116 are fitted into the through channels 115 of the groove 114. The two ends of the connecting member 116 are formed with two protuberances 117 and the central portion of the connecting member 116 is formed a projecting column 118. The protuberances 117 of the connecting member 116 are located in the grooves 114 formed on the bottom of the bases 16. Several connected electric connecting devices 10 can be mounted on the main board 40 at a time for saving time and enhancing the firmness of the base 16 on the main board 40.

Figure 4:
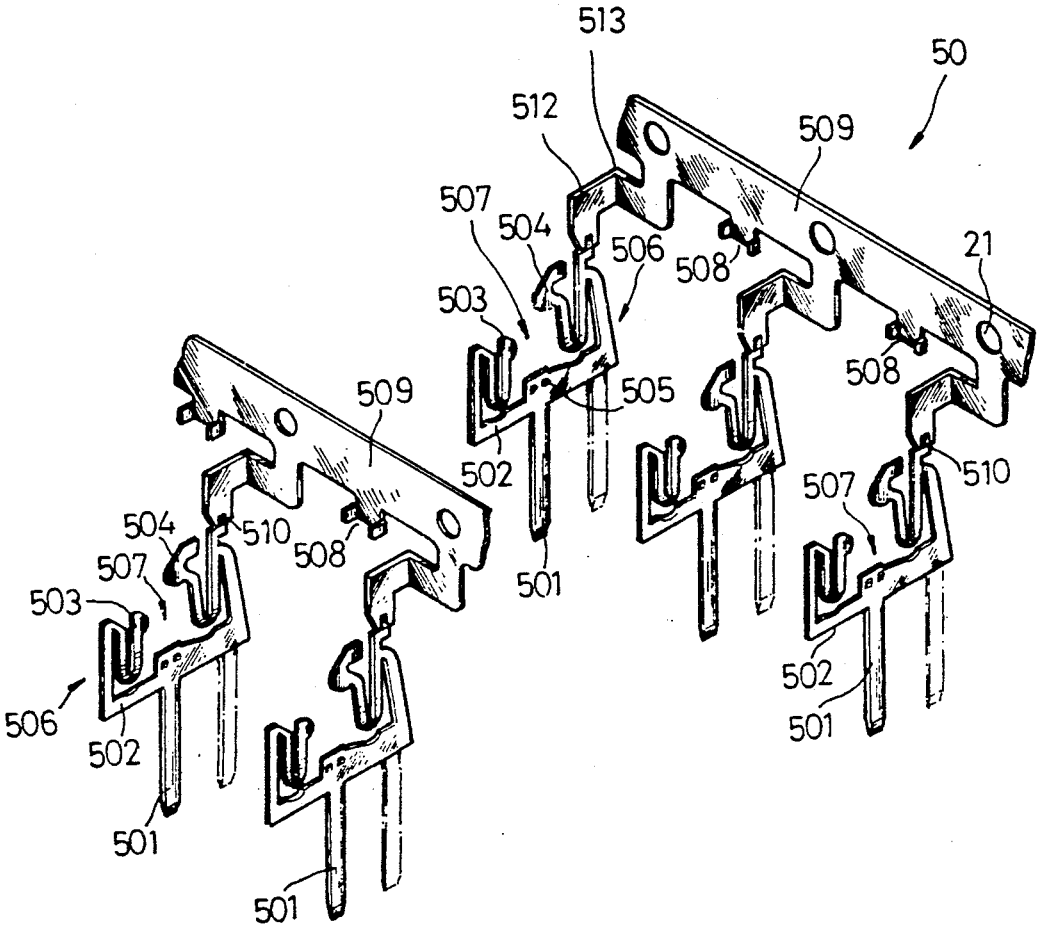
FIG. 4 is a perspective view of a row of electric conducting plates of this invention.

As shown in FIG. 4, the electric conductive plate 50 of this invention includes connecting pin 501, a base portion 502, a front contact portion 503 and a rear contact portion 504. The dotted line is used to indicate an alternatively located connecting pin 501 which meets the requirement of interval between central lines.

Figure 5:
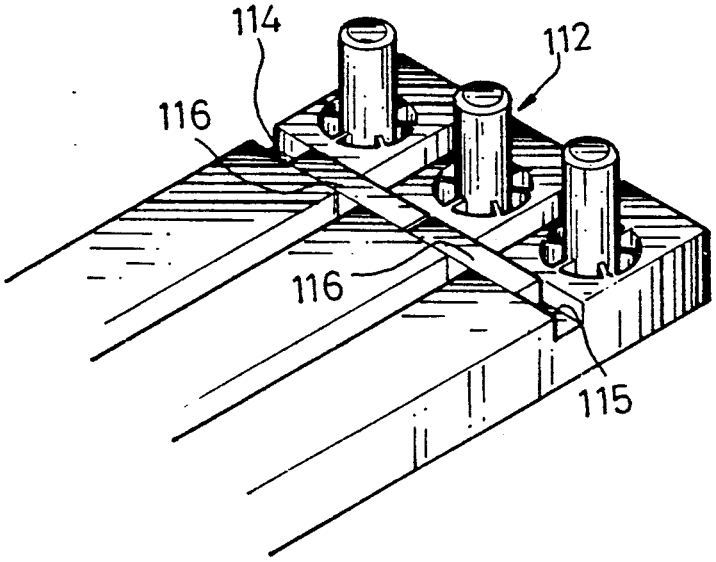
FIG. 5 is a perspective view of several bases connected together.
Figure 6:
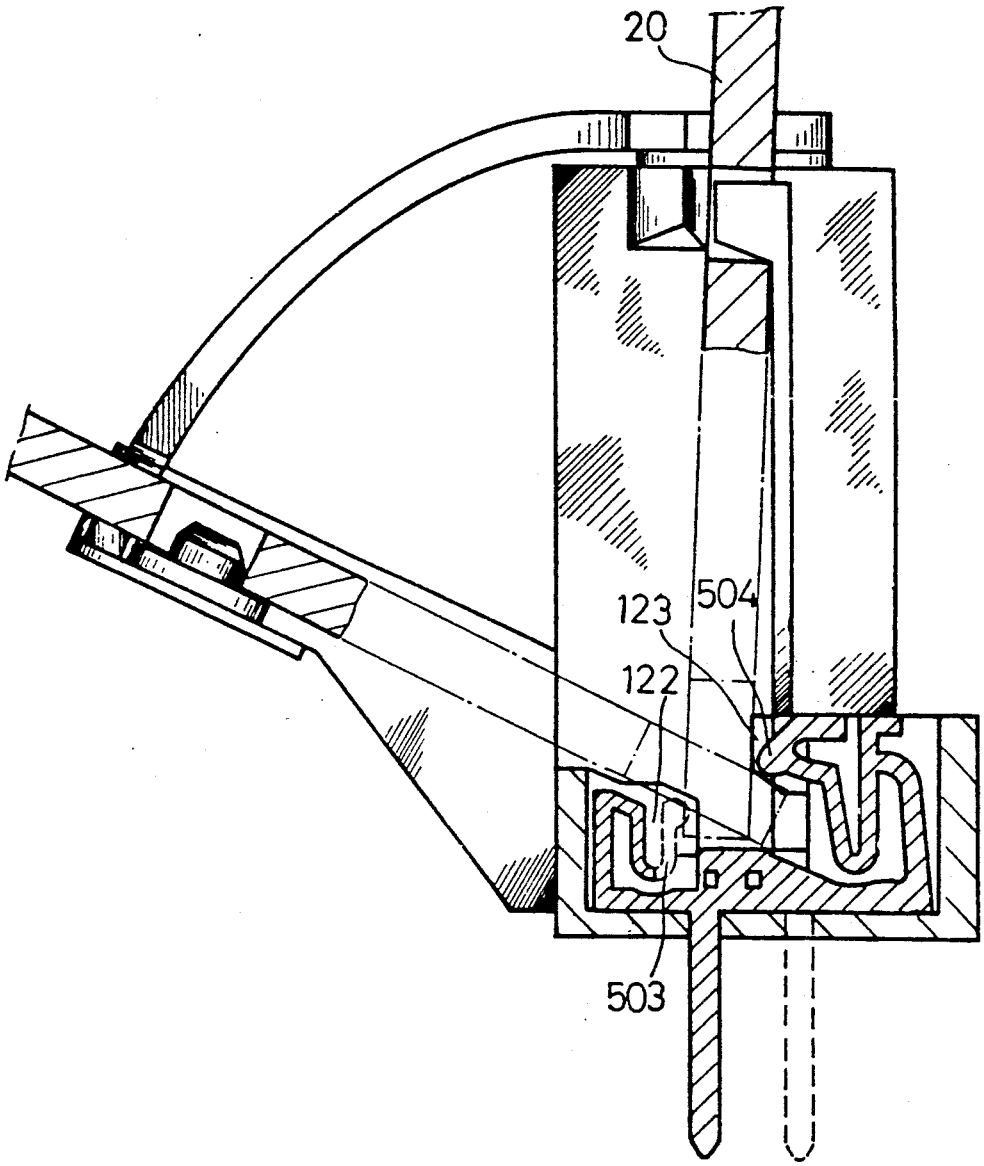
FIG. 6 is a longitudinal sectional view of the large interval subsidiary board after installed.
Figure 8:
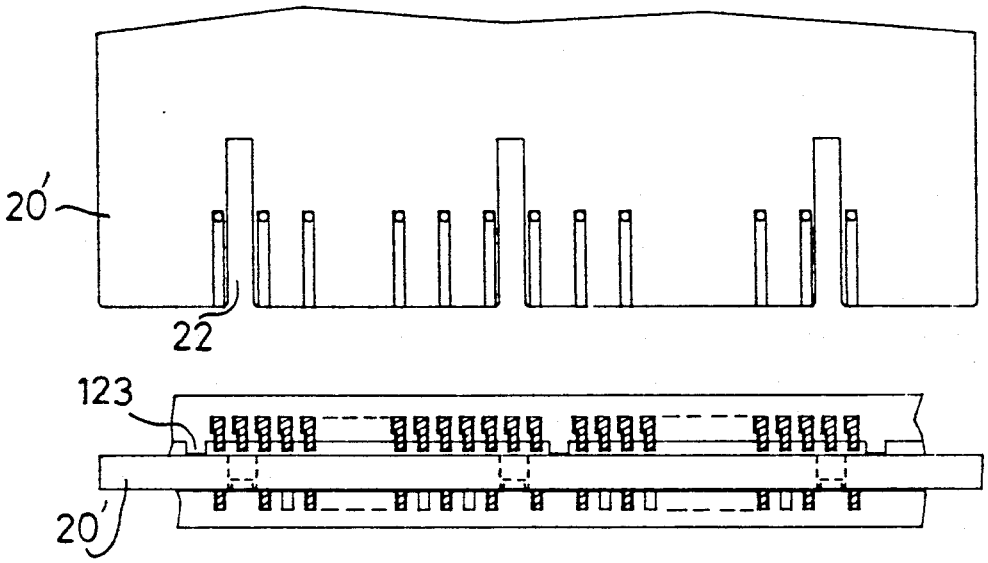
FIG. 8 is a top elevation of the large interval subsidiary board after installed.
Figure 9:
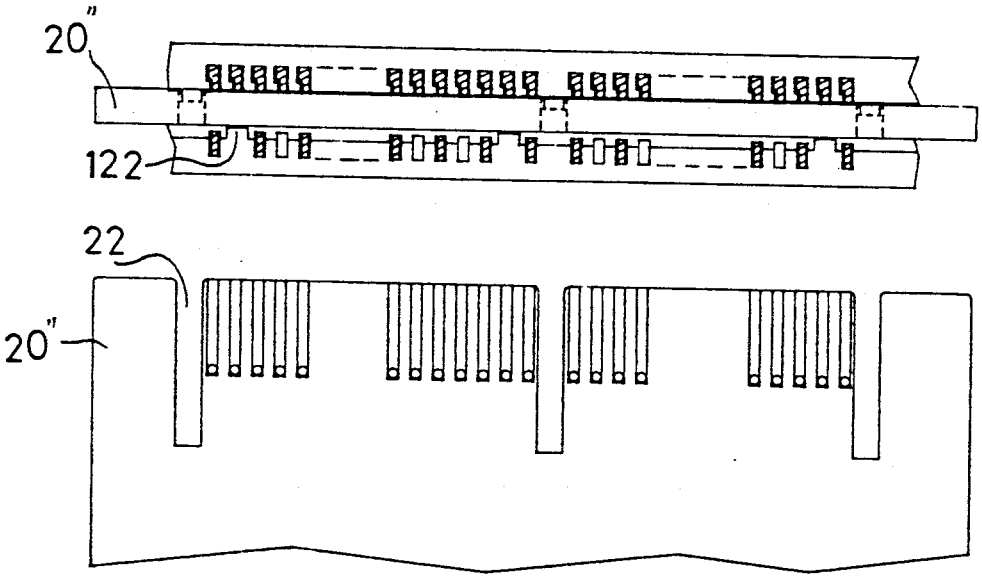
FIG. 9 is a top elevation of the small interval subsidiary board after installed.

A fastening portion 505 is formed on the base portion 502. The fastening portion 505 can be integrally formed by punching the electric conducting plate 506. The fastening portion 505 enables the electric conductive plate 506 to be tightly fitted in the spaced grooves 124. A contact recess 507 is formed between the base portion 502 and front contact portion 503 and rear contact portion for insertion of the subsidiary board 20. Between two electric conducting plates 506 is disposed a locating groove 508 which is located on the material band at predetermined intervals. The locating grooves 508 are integrally formed by means of punching the material band 509. When installed into the spaced grooves 124, the electric conducting plates 50 are overlapped together and located in the locating grooves 508. Several conducting plates 50 can be inserted into the spaced grooves 124 at a time and pressed into proper places and fixed therein. Then the material band is broken at its breaking portions 510 to separate the conducting plates 506 from the material band 509. However, the length of the conducting plate 506 is larger than the interval length between the connecting devices so that the material band of the conducting plate 506 is formed with a 90 bent portion 513 so as to overlap a row of conducting plates 506. The length of one end 512 of the conducting plate 506 is determined by the number of rows of the connecting plate 506. Each increased overlapped row of conducting plate 506 will increase the length of the end 512 by the thickness of the material band. Accordingly, several rows of conducting plates 506 can be overlapped to form a straight arrangement. Such arrangement of insertion of overlapped row of conducting plates is greatly advantageous over conventional arrangement of insertion of single conducting plate. As shown in FIGS. 5 and 6, on two lateral vertical wall of the insert groove 12 are disposed a front and rear stop blocks 122,123 corresponding to the large and small intervals. When the large interval subsidiary board 20' is installed into the spaced groove 507, the front contact portions of every other two conducting plates 50 are spaced by a large interval so that for corresponding to the large interval subsidiary board, every other front contact portions 503 are cut away as shown by dotted line in FIG. 6. After installation, the rear stop block 123 just abuts against one side of the large interval subsidiary board 20'. On the lower end portion of the subsidiary board is formed a recess groove 22 so as not to contact the front stop block 122. In case an inclined type is used, the lower end portion of the large interval subsidiary board 20' will be biased against the slant side 124 of the bottom portion of the rear stop block 123 so that the fixing hole 21 formed on the upper end portion thereof will engage with the fixing boss 34'. In case a small interval subsidiary board 20'' is used, the subsidiary board 20'' is inserted into the spaced groove 507. As shown in FIG. 8, after installation, the front stop block 122 just abuts against one side of the small interval subsidiary board 20'' which is free from contact of the front contact 503 portion. Since the recess groove 22 is formed on the lower portion of the subsidiary board, the rear stop block 123 will not contact the subsidiary board 20''. In case the inclined type is used, the small interval board 20'' will be biased by the slant side 124 of the lower end portion of the front stop block 122 with its upper fixing hole 21 engaged with the fixing boss 34'. Therefore, two alternatives are available for installation of the subsidiary board, i.e., vertical type and inclined type, wherein the inclined locking latch can be installed or not installed according to requirement. The vertically connection type needs a higher using room while the inclined connection type needs a wider using room with smaller height.

It will also be understood that while I have described a presently preferred embodiment of my invention in full detail, it will be obvious that my invention is not to be limited thereto or thereby, but only by that of the appended claims.

What is claimed is:

1. An electric connecting device comprising:

a base formed with a central insert groove, on two vertical walls of said insert groove being formed front and rear stop blocks at large and small intervals, two vertical locking latches being formed at two ends of said insert groove, a slantly curved locking projection being formed at the top of said locking latch, a U-shaped groove being perpendicularly disposed at two ends of said base, at the open end of said U-shaped groove being formed with six inward extending support ribs, a chamber being formed between said base and said support ribs, a guide post being disposed in said chamber and protruding beyond said base, a clearance being formed between said support ribs and said guide post, on inner sides of two guide post being disposed a recess groove, a channel being formed at the central portion of said recess groove;

an inclined locking latch suitable to be inserted into said U-shaped groove of said base, an engaging plate being disposed at a lateral extending portion of an insert pin so as to engage with said engaging groove of said base, an elastic plate being disposed perpendicularly to a connecting plate on the bottom thereof, said connecting plate being faced upward disposed along an extending portion of said engaging plate, a fixing boss being formed on said elastic plate, an arch board being disposed at the top of said insert pin, a locking projecting portion being formed on said arch board;

a series of connecting members disposed in said through channel of said base, at two ends of said connecting member being formed two protuberances, at central portion of said connecting member being formed a projecting column;

a large interval subsidiary board and a small interval subsidiary board inserted into said insert groove of said base, a recess groove being formed on lower end portion of said subsidiary board, a fixing hole being formed on the upper end portion of said subsidiary board;

a row of electric conducting plates disposed in a receiving hole, said electric conducting plate having a connecting pin, a basic portion, a front contact portion and a rear contact portion, a fastening portion being disposed on said basic portion, a contact groove being disposed between said basic portion and front and rear contact portion, a locating groove being disposed between said electric conducting plates, a bent portion being formed on said rear contact portion; and a main board disposed on the bottom of said base, two through holes being formed on said main board corresponding to said two guide post of said base.

* * * * *